US007250107B2

(12) United States Patent
Benazzi et al.

(10) Patent No.: US 7,250,107 B2
(45) Date of Patent: Jul. 31, 2007

(54) FLEXIBLE METHOD FOR PRODUCING OIL BASES AND DISTILLATES FROM FEEDSTOCK CONTAINING HETEROATOMS

(75) Inventors: Eric Benazzi, Chatou (FR); Christophe Gueret, Saint Romain en Gal (FR); Pierre Marion, Antony (FR); Alain Billon, le Vesinet (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 462 days.

(21) Appl. No.: 10/343,006

(22) PCT Filed: Jul. 23, 2001

(86) PCT No.: PCT/FR01/02390

§ 371 (c)(1),
(2), (4) Date: Jul. 14, 2003

(87) PCT Pub. No.: WO02/08363

PCT Pub. Date: Jan. 31, 2002

(65) Prior Publication Data

US 2004/0004021 A1 Jan. 8, 2004

(30) Foreign Application Priority Data

Jul. 26, 2000 (FR) ..... 00 09812

(51) Int. Cl.
*C10G 69/02* (2006.01)

(52) U.S. Cl. ..... 208/89; 208/27; 208/58; 208/62; 208/81; 208/82; 208/83; 208/93; 208/97; 208/188; 208/210; 208/212; 585/310; 585/734; 585/736; 585/737

(58) Field of Classification Search ..... 208/27, 208/58, 62, 81, 82, 83, 89, 93, 212, 97, 188, 208/210; 585/310, 734, 736, 737
See application file for complete search history.

(56) References Cited

U.S. PATENT DOCUMENTS 3,880,746 A 4/1975 Bennett et al.

(Continued)

FOREIGN PATENT DOCUMENTS

EP 0 776 959 6/1997

(Continued)

OTHER PUBLICATIONS

English translation of FR 2 792 946.

*Primary Examiner*—Glenn A. Caldarola
*Assistant Examiner*—Prem C. Singh
(74) *Attorney, Agent, or Firm*—Millen, White, Zelano & Branigan, P.C.

(57) ABSTRACT

For producing basic oils and in particular very high quality oils, i.e. oils possessing a high viscosity index (VI), a low aromatics content, good UV stability and a low pour point, from oil cuts having an initial boiling point higher than 340° C., possibly with simultaneous production of middle distillates (in particular gasoils and kerosene) of very high quality, i.e. having a low aromatics content and a low pour point, the invention provides a flexible procedure for producing oils and middle distillates from a charge containing heteroatoms, i.e. containing more than 200 ppm by weight of nitrogen, and more than 500 ppm by weight of sulphur. The procedure comprises at least one hydrorefining stage, at least one stage of catalytic dewaxing on zeolite, and at least one hydrofinishing stage.

22 Claims, 1 Drawing Sheet

Figure 1:
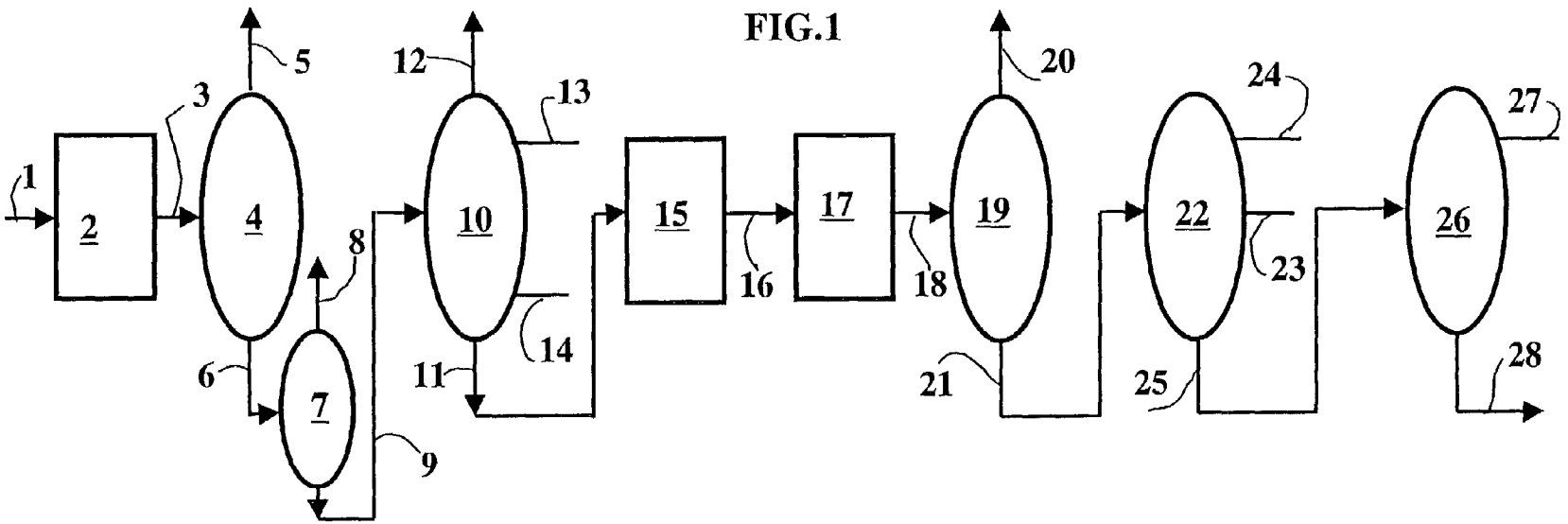

U.S. PATENT DOCUMENTS 4,592,828 A 6/1986 Chu et al.
4,699,707 A 10/1987 Moorehead et al.
4,747,932 A 5/1988 Miller
4,913,797 A * 4/1990 Albinson et al. ..... 208/89
5,976,354 A 11/1999 Powers et al.
6,051,127 A * 4/2000 Moureaux ..... 208/58
6,071,402 A 6/2000 Danot et al.
6,602,402 B1 * 8/2003 Benazzi et al. ..... 208/58

FOREIGN PATENT DOCUMENTS

FR 2217407 9/1974
FR 2 792 946 11/2000
WO WO 95/27020 10/1995

* cited by examiner

FLEXIBLE METHOD FOR PRODUCING OIL BASES AND DISTILLATES FROM FEEDSTOCK CONTAINING HETEROATOMS

The present invention describes an improved procedure for producing basic oils of very high quality, i.e. possessing a high viscosity index (VI), a low aromatics content, good UV stability and a low pour point, from oil cuts having an initial boiling point higher than 340° C., possibly with simultaneous production of middle distillates (in particular gasoils and kerosene) of very high quality, i.e. having a low aromatics content and a low pour point.

More precisely, the invention concerns a flexible procedure for producing basic oils and middle distillates from a charge containing heteroatoms (e.g. N, S, O etc. and preferably without metals), i.e. containing more than 200 ppm by weight of nitrogen, and more than 500 ppm by weight of sulphur. The procedure comprises at least one hydrorefining stage, at least one stage of catalytic dewaxing on zeolite, and at least one hydrofinishing stage.

PRIOR ART

The U.S. Pat. No. 5,976,354 describes a procedure for producing oils comprising these three stages.

The first stage involves the denitrogenization and desulphuration of the charge in the presence of a non-noble metal-based catalyst of Groups VIII and/or VI B and an alumina or silica-alumina support, the preferred catalysts being prepared by impregnation of the preformed support.

The effluent obtained, after stripping of the gases, is treated in the catalytic dewaxing stage on a zeolite ZSM-5 or ZSM-35-based catalyst, or SAPO-type molecular sieve, the catalyst also containing at least one hydrogenating catalytic metal. The procedure ends with a hydrofinishing stage to achieve saturation of the aromatics using a catalyst comprising Pt and Pd oxides on alumina, or else using a preferred catalyst based on zeolite Y.

In a communication of D. V. Law at the 7th Refinery Technology Meeting in Bombay, 6–8 Dec. 1993, a procedure for production of oils and middle distillates is described.

It comprises a first hydrocracking stage achieving denitrogenization, cracking of the low-VI (viscosity index) components and a rearrangement (aromatics saturation, opening of naphthenic cycle) producing high-VI compounds.

This stage is carried out in the presence of a cogel-type catalyst having a uniform strong dispersion of a hydrogenating element and a single pore-size distribution. Such catalysts are reputedly clearly superior to catalysts obtained by impregnation of the support. The catalyst ICR106 is an example. The effluent obtained is distilled, the naphtha, jet fuel and diesel cuts are separated, as are the gases, and the remaining fractions (neutral oils and bright stock) are treated by catalytic dewaxing.

During this stage, isomerization of the n-paraffins is carried out on an ICR404 catalyst. The process also ends with a hydrofinishing stage.

No information is provided concerning the use of the dewaxing and hydrofinishing stages. It is indicated that the VI of the final oil increases according to the wax content of the charge and the severity of the hydrocracking process.

OBJECT OF THE INVENTION

The applicant has focussed its research efforts on providing an improved procedure for manufacturing lubricating oils and very high quality oils in particular.

This invention thus relates to a series of procedures for the joint production of basic oils and middle distillates (in particular gasoils) of very high quality, from oil cuts with an initial boiling point above 340° C. The oils obtained have a high viscosity index VI, a low aromatics content, low volatility, good UV stability and a low pour point.

The present application proposes an alternative procedure to the procedures of the prior art which, by a particular choice of catalysts and conditions, makes it possible to produce good-quality oils and middle distillates, under mild conditions and with long cycle durations.

In particular, and unlike the usual series of procedures or those from the prior state of the art, this procedure is not limited in the quality of the oil products that it makes it possible to obtain; in particular a judicious choice of operating conditions makes it possible to obtain medicinal white oils (i.e. oils of excellent quality).

More precisely, the invention concerns a procedure for production of oils and middle distillates from a charge containing more than 200 ppm by weight of nitrogen, and more than 500 ppm by weight of sulphur, of which at least 20% boils above 340° C., comprising the following stages:

(a) hydrorefining of the charge, carried out at a temperature of 330°–450° C., under a pressure of 5–25 MPa, at a spatial velocity of 0.1–10 $h^{-1}$, in the presence of hydrogen in a hydrogen/hydrocarbon volume ratio of 100:200, and in the presence of an amorphous catalyst comprising a support and at least one non-noble metal of Group VIII, at least one metal of Group VI B, and at least one doping element chosen from the group formed by phosphorus, boron and silicon.

(b) from the effluent obtained in stage (1), separation of at least the gases and compounds with a boiling point below 150° C., (c) catalytic dewaxing of at least part of the effluent produced in stage (b) which contains compounds with a boiling point above 340° C., carried out at a temperature of 200–500° C., under a total pressure of 1–25 MPa, at an hourly volume rate of 0.05–50 $h^{-1}$, with 50–2000 l of hydrogen/l of charge, and in the presence of a catalyst comprising at least one hydro-dehydrogenating element and at least one molecular sieve, (d) hydrofinishing of at least part of the effluent produced in stage (c), carried out at a temperature of 180–400° C., under a pressure of 1–25 MPa, at a volume-time rate of 0.05–100 $h^{-1}$ with 50–2000 l of hydrogen/l of charge, and in the presence of an amorphous catalyst for hydrogenation of the aromatics, comprising at least one hydro-dehydrogenating metal and at least one halogen.

(e) separation of the effluent obtained in stage (d) to obtain at least one oil fraction.

Generally, the effluent produced by the hydrofinishing treatment is subjected to a distillation stage comprising atmospheric distillation and vacuum distillation, in order to separate at least one oil fraction with an initial boiling point above 340° C., and which preferably has a pour point below −10° C., a content by weight of aromatics compounds below 2%, and a VI above 95, a viscosity at 100° C. of at least 3 cSt (i.e. 3 $mm^2/s$) and in order possibly to separate at least one preferred medium distillate fraction, having a pour point below or equal to −10° C. and preferably −20° C., an aromatics content of at least 2% by weight and a polyaromatics content of 1% by weight maximum.

DETAILED DESCRIPTION OF THE INVENTION

The procedure according to the invention comprises the following stages:

Stage (a): Hydrorefining

The hydrocarbonated charge from which the high-quality oils and possibly middle distillates are obtained contains at least 20% by volume boiling above 340° C.

Widely varying charges can therefore be treated by this procedure.

The charge can, for example, be vacuum distillates produced by direct distillation of the crude or of conversion units such as FCC, coker or visco-reduction, or, resulting from desulphuration or hydroconversion of ATRs (atmospheric residues) and/or of VRs (vacuum residues), or hydrocracking residues, or else the charge can be a deasphalted oil, or any mixture of the above-mentioned charges. The above list is not exhaustive. In general, the charges suitable for the oils aimed at have an initial boiling point above 340° C., and, even better, above 370° C.

The nitrogen content of the charge is generally greater than 200 ppm by weight, preferably greater than 400 ppm by weight and still more preferably greater than 500 ppm by weight.

The sulphur content of the charge is generally greater than 500 ppm and most often greater than 1% by weight.

The charge, which may comprise a mixture of the above-mentioned charges, is initially subjected to a hydrorefining process, during which it is brought into contact, in the presence of hydrogen, with at least one catalyst comprising an amorphous support and at least one metal having a hydro-dehydrogenating function provided, for example, by at least one element of Group VI B and at least one element of Group VIII, at a temperature between 330 and 450° C., preferably 360–420° C., under a pressure between 5 and 25 MPa, preferably below 20 MPa, its spatial velocity being between 0.1 and 10 $h^{-1}$ and advantageously between 0.1 and 6 $h^{-1}$, preferably between 0.3–3 $h^{-1}$, and the quantity of hydrogen introduced is such that the hydrogen/hydrocarbon volume ratio is between 100 and 2000.

During the first stage, the use of a catalyst promoting hydrogenation in relation to cracking, used under appropriate thermodynamic and kinetic conditions, allows a considerable reduction in the content of condensed polycyclic aromatic hydrocarbons. Under these conditions, the greater part of the nitrogenated and sulphurated products of the charge are also transformed. This operation thus makes it possible to largely eliminate two types of compounds: the aromatic compounds and the organic nitrogenated compounds initially present in the charge.

Taking account the presence of organic sulphur and nitrogen present in the charge, the stage (a) catalyst will function in the presence of significant quantities of $NH_3$ and $H_2S$ respectively resulting from the hydro-denitrogenation and hydro-desulphuration of the organic nitrogenated and organic sulphurated compounds present in the charge.

In this first stage which involves hydro-denitrogenation, hydro-desulphuration, hydrogenation of the aromatics and cracking of the charge to be treated, the charge is purified whilst simultaneously allowing the properties of the basic oil leaving this first stage to be adjusted with reference to the quality of the basic oil which is to be obtained from this procedure. Advantageously, this regulation can be carried out by taking advantage of the nature and quality of the catalyst used in the first stage and/or the temperature of this first stage, in order to enhance the cracking and hence the viscosity index of the basic oil. If we consider the fraction with an initial boiling point above 340° C. (or even 370° C.), at the end of this stage, its viscosity index obtained after dewaxing using solvent (methyl-isobutyl ketone) at approx. −20° C. is preferably between 80 and 150, or, better, between 90 and 140, even 90 and 135. To obtain such indices, in general the conversion of the charge into cracked products, at boiling points below 340° C. (or even 370° C.), is equal to approximately 60% by weight maximum, or even 50% by weight maximum.

The support is generally based on (or preferably essentially made up of) alumina or amorphous silica-alumina; it can also contain boron oxide, magnesia, zirconia, titanium oxide, or a combination of these oxides. The support is preferably acid. The hydro-dehydrogenating function is preferably achieved by at least one metal or metal compound of Groups VIII and VI preferably chosen from molybdenum, tungsten, nickel and cobalt.

This catalyst can advantageously contain at least one element included in the group formed by the elements phosphorus, boron and silicon.

The preferred catalysts are the catalysts NiMo and/or NiW and also the catalysts NiMo and/or NiW on alumina doped with at least one element contained in the group of atoms formed by phosphorus, boron and silicon, or else the catalysts NiMo and/or NiW on silica-alumina, or on silica-alumina oxide of titanium doped with at least one element contained in the group of atoms formed by phosphorus, boron and silicon.

The still more preferred catalysts are those containing phosphorus, those containing phosphorus and boron, those containing phosphorus, boron and silicon, and those containing boron and silicon. The catalysts which are suitable for use of the procedure according to the invention can also advantageously contain at least one element of Group V B (for example niobium) and/or at least one element of Group VII A (for example fluorine) and/or at least one element of Group VII B (for example rhenium, manganese).

Phosphorus, boron and silicon are preferably introduced as accelerator elements.

The accelerator element and, in particular, the silicon introduced onto the support according to the invention, is mainly located on the support matrix and perhaps characterized by techniques such as the Castaing microprobe (distribution profile of the various elements), electron microscopy by transmission in conjunction with X analysis of the catalyst components, or else by establishing a distribution cartography of the elements present in the catalyst by electronic microprobe. These local analyses will provide the location of the various elements, in particular the location of the accelerator element, in particular the location of the amorphous silicon due to the introduction of the silicon onto the support matrix. The location of the silicon in the structure of the zeolite contained in the support is also revealed. Moreover, a quantitative estimate of the local contents of silicon and other elements may be carried out.

On the other hand the RMN of the $^{29}Si$ solid on rotation to the magic angle is a technique that makes it possible to detect the presence of amorphous silicon introduced into the catalyst.

The total concentration of oxides of metals of Groups VIB (W, Mo being preferred) and VIII (Co, Ni being preferred)

is between 1 and 40%, or even 5 and 40% by weight and preferably between 7 and 30%, and the weight ratio expressed in metal oxide between metal (or metals) of Group VIB on metal (or metals of Group VIII is preferably between 20 and 1.25 and still more preferably between 10 and 2. The catalyst's content of doping element is at least 0.1% by weight and below 60%. The catalyst's phosphorus (oxide) content is generally 20% by weight maximum, preferably 0.1–15%, the boron (oxide) content is generally 20% by weight maximum, preferably 0.1–15%, and the silicon content (oxide and outside matrix) is generally 20% by weight maximum, and preferably 0.1–15%.

The catalyst's content of an element of Group VII A is at the most 20% by weight, preferably 0.1–15%, whilst the content of an element of Group VII B is at the most 50% by weight, preferably 0.01–30% and the content of an element of Group V B at the most 60% by weight, and preferably 0.1–40%.

Thus the advantageous catalysts according to the invention contain at least one element chosen from Co and Ni, at least one element chosen from Mo and W, and at least one doping element chosen from P, B and Si, said elements being deposited on a support.

Other preferred catalysts contain phosphorus and boron as doping elements, deposited on an alumina-based support.

Other preferred catalysts contain boron and silicon as doping elements, deposited on an alumina-based support.

Other preferred catalysts also contain phosphorus in addition to boron and/or silicon.

All these catalysts preferably contain at least one element of Group VIII chosen from Co and Ni, and at least one element of Group VIB chosen from W and Mo.

Stage (B): Stage of Separation of the Products Formed

The effluent resulting from this first stage is conveyed (stage b) to a separation train comprising a means of separating the gases (for example a gas-liquid separator) making it possible to separate gases such as the hydrogen, hydrogen sulphide ($H_2S$), and ammonia ($NH_3$) formed, as well as gaseous hydrocarbons with up to 4 carbon atoms. Then at least one effluent containing products with a boiling point higher than 340° C. is recovered.

Following gas-liquid separation, the effluent undergoes separation of the compounds with a boiling point below 150° C. (gasoline) generally achieved by stripping and/or atmospheric distillation.

The separation stage (b) preferably ends with vacuum distillation.

The separation train can thus be achieved in different ways.

It may for example include a stripper to separate the gasoline formed during stage (a) and the resulting effluent is conveyed into a vacuum distillation column to recover at least one oil fraction and also middle distillates.

In another version, the separation train can include, before the vacuum distillation, atmospheric distillation of the effluent produced by the separator or stripper.

During the atmospheric distillation, at least one medium distillate fraction is recovered. At least one gasoline fraction is obtained in the stripper or during atmospheric distillation. The atmospheric distillation residue is then passed to the vacuum distillation section.

The vacuum distillation makes it possible to obtain a fraction or fractions of oils of different grades depending on the operator's requirements.

Thus at least one fraction of oil is obtained with an initial boiling point above 340° C., or, better, above 370° C., or 380° C., or 400° C.

This fraction, after dewaxing with solvent (methyl-isobutyl ketone) at approx. −20° C., has a VI of at least 80, and generally between 80 and 150 or, better, between 90 and 140 or even 90 and 135.

According to the invention, this fraction (residue) will then be treated alone or in a mixture with one or more other fractions in the catalytic dewaxing stage.

Stage (a) thus leads to the production of compounds with lower boiling points which can advantageously be recovered during the separation stage (b). They include at least one gasoline fraction and at least one medium distillate fraction (for example 150–380° C.) which generally has a pour point below −20° C. and a cetane number above 48.

In another version geared more towards the production of medium distillate with a very low pour point, the cutting point is lowered, and, for example, instead of cutting at 340° C., gas oils and possibly kerosenes can for example be included in the fraction containing the compounds boiling above 340° C. For example, a fraction with an initial boiling point of at least 150° C. is obtained. This fraction will then be passed to the dewaxing section.

Generally, in this text the term "middle distillates" refers to the fraction(s) with an initial boiling point of at least 150° C. and final boiling point up to just before that of the oil (the residue), i.e. generally up to 340° C., or preferably approximately 380° C.

Stage (c): Catalytic Hydrodewaxing (CHDW)

At least one fraction containing the compounds boiling above 340° C., as defined above, resulting from stage (b) is then subjected, alone or in mixture with other fractions resulting from the resulting from the sequence of stages (a) and (b) of the procedure according to the invention, to a catalytic dewaxing stage in the presence of hydrogen and a hydrodewaxing catalyst comprising an acid function and a hydro-dehydrogenating metallic function and at least one matrix.

It should be noted that the compounds boiling above 340° C. are preferably always subjected to catalytic dewaxing, whatever the method of separation chosen in stage (b).

The acid function is provided by at least one molecular sieve whose microporous system has at least one main type of channel whose openings are formed from rings containing 10 or 9 T atoms. The T atoms are tetrahedral atoms making up the molecular sieve and can be at least one of the elements contained in the group following the atoms (Si, Al, P, B, Ti, Fe, Ga). In the rings forming the channel openings, the T atoms, defined above, alternate with an equal number of oxygen atoms. Thus to say that the openings are formed from rings containing 10 or 9 oxygen atoms is equivalent to saying that they are formed from rings containing 10 or 9 T atoms.

The molecular sieve used to make up the hydrodewaxing catalyst can also comprise other types of channels, whose openings are formed from rings containing less than 10 T atoms or oxygen atoms.

The molecular sieve used to make up the catalyst also has a bridge width, i.e. the distance between two pore openings, as defined above, which is no greater than 0.75 nm (1 nm=$10^{-9}$ m), preferably between 0.50 nm and 0.75 nm, and still more preferably between 0.52 nm and 0.73 nm.

The bridge width is measured by using a graphic and molecular modelling tool such as Hyperchem or Biosym, which makes it possible to construct the surface of the molecular sieves in question and, taking account the ion rays of the elements present in the sieve structure, to measure the bridge width.

The catalyst suitable for this procedure is characterized by a catalytic test known as a standard pure n-decane transformation test which is carried out under partial pressure of 450 kPa of hydrogen and partial pressure of n-$C_{10}$ of 1.2 kPa, i.e. a total pressure of 451.2 kPa in a fixed bed and with a constant n-$C_{10}$ rate of flow of 9.5 ml/h, a total rate of flow of 3.6 l/h and a catalyst mass of 0.2 g. The reaction is carried out in a descending flow. The rate of conversion is controlled by the temperature at which the reaction takes place. The catalyst subjected to said test is made up of pure pelletized zeolite and 0.5% by weight of platinum.

The n-decane, in the presence of the molecular sieve and a hydro-dehydrogenating function, will undergo hydroisomerization reactions which will produce isomerized products with 10 carbon atoms, and hydrocracking reactions leading to the formation of products containing less than 10 carbon atoms.

Under these conditions a molecular sieve used in the hydrodewaxing stage according to the invention must have the physicochemical characteristics described above and lead, for a yield of n-$C_{10}$ isomerized products in the region of 5% by weight (the rate of conversion is controlled by the temperature), to a 2-methyl nonane/5-methyl nonane ratio greater than 5 and preferably greater than 7.

The use of molecular sieves thus selected, under the conditions described above, from the numerous molecular sieves already existing, makes it possible in particular to produce products with a low pour point and high viscosity index with good yields within the framework of the procedure according to the invention.

The molecular sieves that can be used to make up the catalytic hydrodewaxing catalyst are, for example, the following zeolites: Ferrierite, NU-10, EU-13, ZSM-48 and zeolites of the same structural type.

The molecular sieves used to make up the hydrodewaxing catalyst are preferably contained within the group formed by ferrierite and the zeolite EU-1.

The content by weight of the molecular sieve in the hydrodewaxing catalyst is between 1 and 90%, preferably between 5 and 90% and still more preferably between 10 and 85%.

The matrices used for formation of the catalyst include the examples in the following list, which is not exhaustive: alumina gels, aluminas, magnesia, amorphous silica-aluminas, and mixtures of these. Techniques such as extrusion, pelletization or bowl granulation can be used to carry out the formation operation.

The catalyst also includes a hydro-dehydrogenation function, provided, for example, by at least one element of Group VII and preferably at least one element included in the group formed by platinum and palladium.

The content by weight of non-noble metal of Group VIII, in relation to the final catalyst, is between 1 and 40%, preferably between 10 and 30%. In this case, the non-noble metal is often associated with at least one metal of Group VIB (Mo and W being preferred). If there is at least one noble metal of Group VIII, the content by weight, in relation to the final catalyst, is below 5%, preferably below 3% and still more preferably below 1.5%.

In the case of utilization of noble metals of Group VIII, the platinum and/or palladium are preferably located on the matrix, defined as above.

The hydrodewaxing catalyst according to the invention can, moreover, contain 0 to 20%, preferably 0 to 10% by weight (expressed in oxides) of phosphorus. The combination of metal(s) of Group VI B and/or metal(s) of Group VIII with phosphorus is particularly advantageous.

If we consider the fraction of the effluent with a boiling point above 340° C. which can be obtained at the end of stages (a) and (b) of the procedure according to the invention, and which is to be treated in this hydrodewaxing stage (c), it has the following characteristics: an initial boiling point above 340° C. and preferably above 370° C., a pour point of at least 15° C., a nitrogen content below 10 ppm by weight, a sulphur content below 50 ppm by weight, preferably below 20 ppm, or even better, below 10 ppm by weight, a viscosity index obtained after dewaxing with solvent (methyl isobutyl ketone) at approximately −20° C., which is at least equal to 80, preferably between 80 and 150, and, better, between 90 and 140 or even 90 and 135, an aromatics compounds content below 15% and preferably below 10% by weight, a viscosity at 100° C. above or equal to 3 cSt ($mm^2/s$).

The operating conditions under which the hydrodewaxing stage of the procedure according to the invention takes place are as follows:

- the reaction temperature is between 200 and 500° C., preferably between 250 and 470° C., and advantageously 270–430° C.;
- the pressure is between 0.1 (or 0.2) and 25 MPa ($10^6$ Pa) and preferably between 0.5 (1.0) and 20 MPa;
- the hourly volume rate (hvr expressed as the volume of charge injected per catalyst volume unit and per hour) is between approximately 0.05 and approximately 50 and preferably between approximately 0.1 and approximately 20 $h^{-1}$ and, still more preferably, between 0.2 and 10 $h^{-1}$.

These are chosen so as to obtain the desired pour point.

Contact between the charge entering the dewaxing section and the catalyst takes place in the presence of hydrogen. The rate of hydrogen used and expressed in litres of hydrogen per litre of charge is between 50 and approximately 2000 litres of hydrogen per litre of charge, and preferably between 100 and 1500 litres of hydrogen per litre of charge.

Stage (d): Hydrofinishing

The effluent from the catalytic hydrodewaxing stage, preferably in its entirety and without intermediate distillation, is passed to a hydrofinishing catalyst in the presence of hydrogen, in order to achieve accelerated hydrogenation of the aromatic compounds which are detrimental to the stability of oils and distillates. However the acidity of the catalyst must be sufficiently low not to lead to too much formation of cracked products with a boiling point below 340° C., so as not to degrade the final yields of oils in particular.

The catalyst used in this stage comprises at least one metal of Group VIII and/or at least one element of Group VIB of the periodic table. Strong metallic functions: platinum and/or palladium, or nickel-tungsten, or nickel-molybdenum combinations will be advantageously used to achieve accelerated hydrogenation of the aromatics.

These metals are deposited and dispersed on a support of the crystalline or amorphous oxide type, such as for example, aluminas, silicas, silica-aluminas. The support contains no zeolite.

The hydrofinishing (HDF) catalyst can also contain at least one element of Group VII A of the periodic table of the elements. These catalysts preferably contain fluorine and/or chlorine.

The contents by weight of metals are between 10 and 30% in the case of non-noble metals and below 2%, preferably between 0.1 and 1.5%, and still more preferably between 0.1 and 1.0% in the case of the noble metals.

The total quantity of halogen is between 0.02 and 30% by weight, advantageously within the range 0.01 to 15%, or 0.01 to 10%, or preferably 0.01 to 5%.

Among the catalysts that can be used in this HDF stage, leading to excellent performances, in particular to obtain medicinal oils, mention may be made of catalysts containing at least one noble metal of Group VIII (platinum for example) and at least one halogen (chorine and/or fluorine), a combination of chlorine and fluorine being preferred. A preferred catalyst is made up of noble metal, chlorine, fluorine and alumina.

The operating conditions under which the hydrofinishing stage of the procedure according to the invention takes place are as follows:

- the reaction temperature is between 180 and 400° C., preferably between 210 and 350° C., and advantageously 220–320° C.;
- the pressure is between 0.1 and 25 MPa ($10^6$ Pa) and preferably between 1.0 and 20 MPa;
- the hourly volume rate (hvr expressed as the volume of charge injected per catalyst volume unit and per hour) is between approximately 0.05 and approximately 100 and preferably between approximately 0.1 and approximately 30 $h^{-1}$.

Contact between the charge and the catalyst takes place in the presence of hydrogen. The rate of hydrogen used and expressed in litres of hydrogen per litre of charge is between 50 and approximately 2000 litres of hydrogen per litre of charge, and preferably between 100 and 1500 litres of hydrogen per litre of charge.

Generally the temperature of the HDF stage is lower than the temperature of the catalytic hydrodewaxing (CHDW) stage. The difference between $T_{CHDW}$ and $T_{HDF}$ is generally between 20 and 200 and preferably between 30 and 100° C.

Stage (e): Separation

The effluent from the HDF stage is passed into a separation or distillation train, which includes separation of the gases (for example by means of a gas-liquid separator) making it possible to separate from the liquid products, gases such as hydrogen and gaseous hydrocarbons comprising 1–4 carbon atoms. This separation train can also include separation of the compounds with a boiling point below 150° C. (gasoline) formed during the previous stages (for example stripping and/or atmospheric distillation). Separation stage (a) ends with a vacuum distillation process to recover at least one oil fraction. The middle distillates formed during the previous stages are also recovered during separation in stage (e).

The separation train can be achieved in different ways.

It may for example comprise a stripper to separate the gasoline formed during stage (a) and the resulting effluent is passed into a vacuum distillation column to recover at least one oil fraction and also middle distillates.

In another version, the separation train may include, before the vacuum distillation section, a section for atmospheric distillation of the effluent from the separator or stripper. In the atmospheric distillation section, at least one medium distillate fraction is recovered (these are the distillates formed during the previous stages). At least one gasoline fraction is obtained in the stripper or the atmospheric distillation section. The atmospheric distillation residue is passed to the vacuum distillation section.

The vacuum distillation makes it possible to obtain the oil fraction or fractions of different grades depending on the requirements of the operator.

All the combinations are possible, the cutpoints being adjusted by the operator on the basis of his requirements (product specifications for example).

This separation also makes it possible to improve the characteristics of the oil fraction, such as for example NOACK and viscosity, by choosing the cutpoint between gasoil and the oil fraction.

The basic oils obtained according to this procedure most often have a pour point below −10° C., a content by weight of aromatic compounds below 2%, an IV above 95, preferably above 105 and still more preferably above 120, a viscosity of at least 3.0 cST at 100° C., an ASTM D1500 colour below 1, and preferably below 0.5, and UV stability such that the ASTM D1500 colour increase is between 0 and 4, and preferably between 0.5 and 2.5.

The UV stability test, adapted from the ASTM D925-55 and D1148–55 procedures, provides a quick method for comparing the stability of lubricating oils exposed to a source of ultraviolet rays. The test chamber is made up of a metal enclosure with a turning plate on which the oil samples are placed. A bulb producing the same ultraviolet rays as those of sunlight, and positioned at the top of the test chamber, is directed downwards onto the samples. The samples include a standard oil with known UV characteristics. The ASTM D1500 colour of the samples is determined at t=0, then after 45 hours of exposure at 55° C. The results are transcribed for the standard sample and the test samples as follows:

a) initial ASTM D1500 colour, b) final ASTM D1500 colour, c) increase in colour, d) cloudy, e) precipitate.

Another advantage of the procedure according to the invention is that it also makes it possible to obtain medicinal white oils. Medicinal white oils are mineral oils obtained by accelerated refining of oil, their quality is subject to various regulations aimed at guaranteeing their harmlessness for pharmaceutical applications, they are non-toxic and are characterized by their density and viscosity. Medicinal white oils are essentially made up of saturated hydrocarbons, they are chemically inert and have a low aromatic hydrocarbons content. Particular attention is paid to aromatic compounds and in particular to 6 polycyclic aromatic hydrocarbons (P.A.H.) which are toxic and present in concentrations of one part per billion by weight of aromatic compounds in the white oil. Control of the total aromatics content can be carried out by the method ASTM D 2008; this UV adsorption test at 275, 292 and 300 nanometres makes it possible to regulate absorbency below 0.8, 0.4 and 0.3 respectively. These measures are effected with concentrations of 1 g of oil per litre, in a 1 cm container. Commercial white oils are differentiated by their viscosity but also by their original crude, which may be paraffinic or napthenic; these two parameters will lead to differences in both the physicochemical properties of the white oils under consideration, and also their chemical composition.

Currently oil cuts, whether originating from direct distillation of a crude oil followed by extraction of the aromatic compounds by a solvent, or resulting from the catalytic hydrorefining or hydrocracking process, still contain significant quantities of aromatic compounds. Under the current legislation of most industrialized countries, "medicinal" white oils must have an aromatics content below a threshold imposed by the law of each of these countries. The absence of these aromatic compounds from the oil cuts is shown by a Saybolt colour specification which must be clearly at least 30 (+30), a maximum UV adsorption specification which must be below 1.60 to 275 nm on a pure product in a 1 centimetre container and a maximum specification for absorption of DMSO extraction products which must be below 0.1 for the American market (Food and Drug Administration Standard no. 1211145). This last test consists of specifically extracting polycyclic aromatic hydrocarbons using a polar solvent, often DMSO, and checking their content in the extract by a UV absorption measurement in the range 260–350 nm.

In addition, the medicinal white oils must also satisfy the carbonizable substances test (ASTM D565). This consists of heating and agitating a mixture of white oil and concentrated sulphuric acid. After settling out of the phases, the acid layer must have a less intense coloration than that of a coloured reference solution or of that resulting from combination of two glasses coloured yellow and red.

The middle distillates resulting from the series of stages of the procedure according to the invention have pour points below or equal to −10° C. and generally −20° C., low aromatics contents (2% by weight maximum), polyaromatics contents (di and more) below 1% by weight, and in the case of gas oils, a cetane number greater than 50 and even greater than 52.

Another advantage of the procedure according to the invention is that the total pressure can be the same in all the reactors of stages (c) and (d) making it possible to work in series and thus to generate cost economies.

The present invention also relates to an installation that can be used for carrying out the procedure described above.

The installation comprises:

- a hydrorefining zone (2) containing a hydrorefining catalyst and having at least one pipe (1) for introducing the charge to be treated.
- a separation train comprising at least one means of separation of the gases (4) with one pipe (3) carrying the effluent produced in zone (2), said means having at least one pipe (5) for removal of the gases, at least one means (7) for separation of the compounds with a boiling point below 150° C., said means having at least one pipe (8) for removal of the fraction containing the compounds boiling below 150° C., and at least one pipe (9) for removal of an effluent containing compounds boiling at at least 150° C., said train also comprising at least one vacuum distillation column (10) for treatment of said effluent, said column having at least one pipe (11) for removal of at least one oil fraction,
- a catalytic dewaxing zone (15) for treatment of at least one oil fraction, having at least one pipe (16) for removal of the dewaxed effluent,
- a hydrofinishing zone (17) for treatment of the dewaxed effluent from the pipe (16) and having at least one pipe (18) for removal of the hydrofinished effluent,
- a final separation train comprising at least one means of separation of the gases (19) having at least one pipe (18) carrying the hydrofinished effluent, said means having at least one pipe (20) for removal of the gases, at least one means (22) of separation of the compounds with a boiling point below 150° C., said means having at least one pipe (24) for removal of the fraction containing the compounds boiling below 150° C., and at least one pipe (25) for removal of an effluent containing compounds boiling at at least 150° C., said train also comprising at least one vacuum distillation column (26) for treatment of said effluent, said column having at least one pipe (28) for removal of at least one oil fraction.

The description can be better followed by referring to FIG. 1.

The charge is introduced by the pipe (1) in the hydrorefining zone (2) which comprises one or more catalytic beds of a hydrorefining catalyst, arranged in one or more reactors.

The effluent leaving the hydrorefining zone by the pipe (3) is passed into a separation train. According to FIG. 1, this train comprises a means of separation (4) to separate the light gases ($H_2S$, $H_2$, $NH_2$ etc. C1–C4) removed by the pipe (5).

The "degassed" effluent is carried by the pipe (6) into a means of separation of the compounds with a boiling point below 150° C., which is for example a stripper (7) having a pipe (8) for removal of the 150-fraction and a pipe (9) to carry the stripped effluent into a vacuum distillation column (10).

Said column makes it possible to separate at least one oil fraction removed for example by the pipe (11), and by at least one pipe (12), at least one medium distillate fraction is removed. Depending on the requirements of the operator, the light oil fractions may possibly be separated into different grades, removed by the pipes (13) (14) in FIG. 1.

The oil fraction obtained in the pipe (11) is passed into the catalytic dewaxing zone (15) which comprises one or more catalytic beds of catalytic dewaxing catalyst, arranged in one or more reactors. The oil fractions in the pipes (13) (14) can also be passed into the zone (12), alone, or mixed with each other or with the heavier oil from the pipe (11).

The dewaxed effluent thus obtained is all removed from the zone (15) by the pipe (16). It is then treated in the hydrofinishing zone (17) which comprises one or more catalytic beds of hydrofinishing catalyst, arranged in one or more reactors.

The hydrofinished effluent thus obtained is removed by the pipe (18) to the final separation train.

In FIG. 1, this train comprises a means of separation (19) for separation of the light gases removed by the pipe (20).

The "degassed" effluent is carried by the pipe (21) into a distillation column. In FIG. 1, this is an atmospheric distillation column (22) to separate one or more medium distillate fractions removed by, for example, a pipe (23) and possibly a gasoline fraction removed by a pipe (24).

In FIG. 1, the atmospheric distillation residue removed by the pipe (25) is carried into a vacuum distillation column (26) which separates one or more light oil fractions (according to the requirements of the operator) removed by at least one pipe, for example one pipe (27) and makes it possible to recover a basic oil fraction by the pipe (28).

Figure 2:
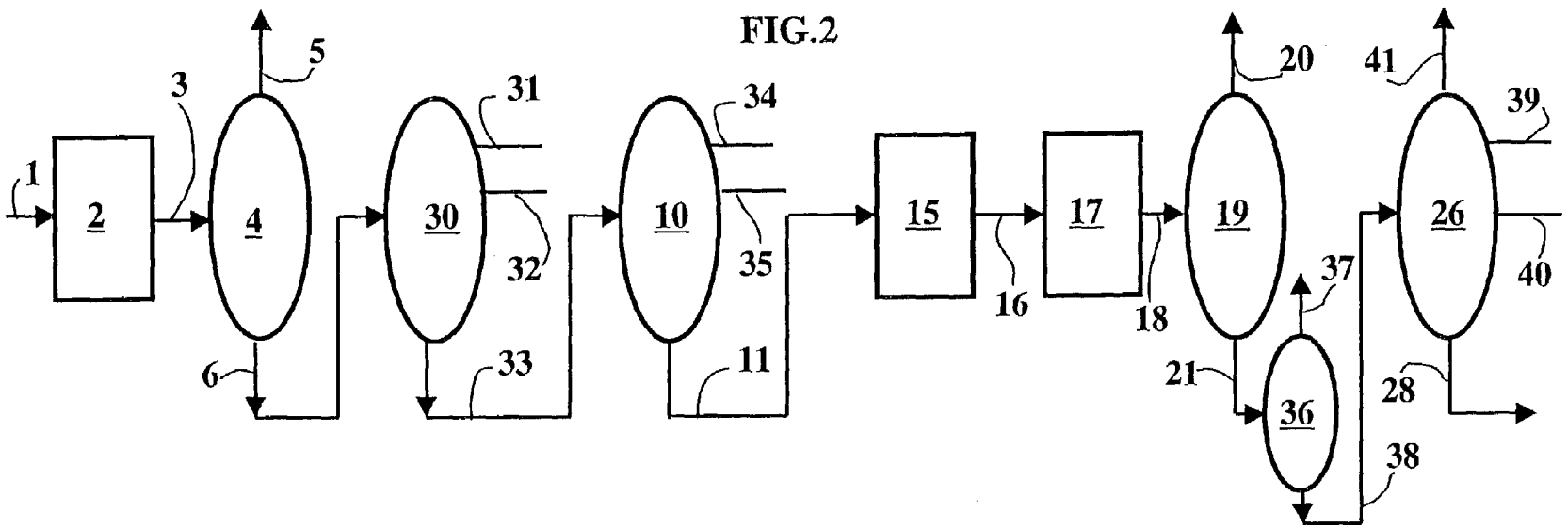

In FIG. 2, another method of separation is represented.

Not all the elements denoted by the reference marks will be described, but only the separations.

In FIG. 2, the effluent produced in the zone (2) which has been degassed is carried by the pipe (6) into a distillation column (30) which, here, is an atmospheric distillation column. In this column, one or more gasoline and/or medium distillate fractions are separated and removed by the pipes (31, (32) in FIG. 2, and the residue containing the heavy products (boiling point generally above 340° C., or even 370° C. or above) is removed by the pipe (33).

This residue is, according to FIG. 2, carried into a vacuum distillation column (10) from which an oil fraction is separated by the pipe (11) and one or more light oils of different grades may possibly be removed by one or more pipes (34), (35) for example, if the operator wishes to obtain these.

In FIG. 2, the final separation train comprises a means of separation of gases (19) in which the hydrofinished effluent is introduced by the pipe (18) and leaves, "degassed", by the pipe (21).

This degassed effluent is carried into a stripper (36) having a pipe (37) to remove the $150^{-}$ fraction and a pipe (38) by which the stripped effluent is removed. Said effluent is passed into a vacuum distillation column (26) which makes it possible to separate one basic oil fraction by the pipe (28) and at least one lighter fraction. Here, these lighter fractions are for example light oils removed by the pipes (39) (40) and a single fraction removed by the pipe (41) and containing gasoline and middle distillates.

It will be understood that any combination of the separation trains is possible, providing that the train comprises a means for removing the light gases, a means for separating the $150^{-}$fraction (stripper, atmospheric distillation), and a vacuum distillation section to separate the fraction containing products with a boiling point above 340° C. (oil or basic oil fraction). Generally, the vacuum columns used directly after the stripper are regulated so as to separate at the top fractions with a boiling point below 340° C., or 370° C. or more (for example 380° C.). In fact, the operator will control the cutpoints according to the products to be obtained and, for example, if he wishes to produce light oils.

The series plus traditional separator, atmospheric distillation column and vacuum distillation column is most often used for the final separation train.

The combination of FIG. 1 is of particular interest with regard to the quality of the separation (and thus of the products obtained) for a very favourable cost (saving of one column).

The invention claimed is:

1. A process for the production of oils and middle distillates from a charge containing more than 200 ppm by weight of nitrogen and more than 500 ppm by weight of sulphur, of which at least 20% by volume boils above 340° C., the charge comprises vacuum distillates produced by direct distillation of the crude or conversion units, hydrocracking residues, vacuum distillates produced by desulphuration or hydroconversion of atmospheric residues or vacuum residues; deasphalted oils or mixtures of these, comprising the following stages:

(a) hydrorefining of the charge at a maximum conversion rate of 60% by weight, carried out at a temperature of 330° C.–450° C., under a pressure of 5–25 MPa, at a spatial velocity of $0.1–10h^{-1}$, in the presence of hydrogen in the hydrogen/hydrocarbon volume ratio of 100–2000, in the presence of a catalyst consisting essentially of an amorphous support, at least one non-noble metal of Group VIII and at least one metal of Group VIB, and at least one doping element selected from phosphorus, boron and silicon, to effect hydrodenitrogenation, hydrodesulfuration, and hydrogenation of aromatics and cracking (b) from the effluent obtained in stage (a), separation of the gases followed by separation of the compounds with a boiling point below 150° C., and subjecting the fraction boiling above 150° C. to distillation to obtain a fraction having an initial boiling point above 340° C., (c) catalytic dewaxing of at least part of the fraction from stage (b), having an initial boiling point above 340° C., carried out at a temperature of 200–500° C., under a total pressure of 1–25 MPa, at an hourly space velocity of $0.05–50\ h^{-1}$, with 50–2000 l of hydrogen/l of charge, and in the presence of a catalyst comprising at least one hydro-dehydrogenating element and at least one molecular sieve, (d) hydrofinishing of at least part of the effluent from stage (c), carried out at a temperature of 180–400° C., under a pressure of 1–25 MPa, at an hourly space velocity of $0.05–100\ h^{-1}$, in the presence of 50–2000 l of hydrogen/l of charge, and in the presence of a hydrofinishing catalyst comprising an amorphous carrier, at least one hydro-dehydrogenating metal and at least one halogen, (e) separation of the effluent obtained in stage (d) to obtain at least one oil fraction.

2. A process according to claim 1, in which the hydrorefining catalyst contains at least one element selected from Co and Ni, at least one element selected from Mo and W, and at least one doping element selected from P, B and Si, said elements being deposited on a support.

3. A process according to claim 1, in which the hydrorefining catalyst contains as doping elements phosphorus and boron deposited on an alumina-based support.

4. A process according to claim 1, in which the hydrorefining catalyst contains as doping elements boron and silicon deposited on an alumina-based support.

5. A process according to claim 4, in which the catalyst also contains phosphorus.

6. A process according to claim 1, in which the support of the hydrorefining catalyst is an acid support.

7. A process according to claim 1, in which the hydrorefining catalyst also contains at least one element selected from the elements of Group VB, the elements of Group VIIA and the elements of Group VIIB.

8. A process according to claim 7, in which the hydrorefining catalyst contains at least one element selected from niobium, fluorine, manganese and rhenium.

9. A process according to claim 1, in which the molecular sieve of stage (c) is selected from the group of zeolites formed by ferrierite, NU-10, EU-13, EU-1, ZSM-48 and zeolites of the same structural type.

10. A process according to claim 1, in which the hydrofinishing catalyst contains at least one metal of Group VIII and/or at least one metal of Group VIB, a support without zeolite and at least one element of Group VIIA.

11. A process according to claim 10, in which the catalyst contains platinum, chlorine and fluorine.

12. A process according to claim 1, in which, in the hydrorefining stage, the conversion into products with boiling points below 340° C. is equal to 50% by weight maximum.

13. A process according to claim 1, in which stage (b) and/or stage (e) is carried out by gas-liquid separation, then stripping followed by vacuum distillation.

14. A process according to claim 13, in which stage (b) and/or stage (e) is carried out by gas-liquid separation, then atmospheric distillation followed by vacuum distillation.

15. A process according to claim 1, in which the charge is selected from vacuum distillates produced by direct distillation of the crude or conversion units, hydrocracking residues, vacuum distillates from desuiphuration or hydroconversion of atmospheric residues and vacuum residues and mixtures thereof.

16. An installation for the production of oils and middle distillates comprising:

a hydrorefining zone (2) containing a hydrorefining catalyst, and having at least one pipe (1) to introduce the charge to be treated a separation train comprising at least one means of separation of the gases (4) having a pipe (3) carrying the effluent from zone (2), said means having at least one pipe (5) for removal of the gases, at least one means (7) of separation of the compounds with a boiling point below 150° C., said means having at least one pipe (8) for removal of the fraction containing the compounds boiling below 150° C., and at least one pipe (9) for removal of an effluent containing compounds boiling at at least 150° C., said train also comprising at least one vacuum distillation column (10) for treatment of the latter effluent, said column having at least one pipe (11) for removal of at least one oil fraction, a catalytic dewaxing zone (15) for treatment of at least one oil fraction, and having at least one pipe (16) for removal of the dewaxed effluent, a hydrofinishing zone (17) for treatment of the dewaxed effluent from the pipe (16), and having at least one pipe (18) for removal of the hydrofinished effluent, a final separation train comprising at least one means of separation of the gases (19) having at least one pipe (18) carrying the hydrofinished effluent, said means having at least one pipe (20) for removal of the gases, at least one means (22) of separation of the compounds with a boiling point below 150° C., said means having at least one pipe (24) for removal of the fraction containing compounds boiling below 150° C., and at least one pipe (25) for removal an effluent containing compounds boiling at least 150° C., said train also comprising at least one vacuum distillation column (26) for treatment of said effluent, said column having at least one pipe (28) for removal of at least one oil fraction.

17. Installation according to claim 16 in which the means of separation of the gases (4) (19) is a gas—liquid separator.

18. Installation according to claim 16 in which the means of separation (7) of the compounds with a boiling point below 150° C. is a stripper and the stripped effluent removed by the pipe (9) is passed into a vacuum distillation column (10), having at least one pipe (11) for removal of at least one oil fraction and at least one pipe (12) for removal of at least one medium distillate fraction.

19. Installation according to claim 16 in which the means of separation (22) of the compounds with a boiling point below 150° C. is an atmospheric distillation section, having at least one pipe (23) for removal of at least one medium distillate fraction, at least one pipe (24) for removal of at least one gasoline fraction, and at least one pipe (25) for removal of the residue, said residue being passed into a vacuum distillation column (26) separating at least one oil fraction removed by at least one pipe (28).

20. A process according to claim 2, in which the molecular sieve of stage (c) is selected from the group of zeolites formed by ferrierite, NU-10, EU-13, EU-1, ZSM-48 and zeolites of the same structural type.

21. A process according to claim 2, in which the hydrofinishing catalyst contains at least one metal of Group VIII and/or at least one metal of Group VIB, a support without zeolite and at least one element of Group VIIA.

22. A process according to claim 20, in which the hydrofinishing catalyst contains at least one metal of Group VIII and/or at least one metal of Group VIB, a support without zeolite and at least one element of Group VIIA.

* * * * *